US010487598B2

(12) United States Patent
Lutcherath

(10) Patent No.: US 10,487,598 B2
(45) Date of Patent: Nov. 26, 2019

(54) STORAGE ARRANGEMENT FOR WELL OPERATIONS

(71) Applicant: MHWIRTH AS, Kristiansand S (NO)

(72) Inventor: Viggo Lutcherath, Kristiansand S (NO)

(73) Assignee: MHWIRTH AS, Kristiansand S (NO)

( * ) Notice: Subject to any disclaimer, the term of this patent is extended or adjusted under 35 U.S.C. 154(b) by 215 days.

(21) Appl. No.: 15/426,069

(22) Filed: Feb. 7, 2017

(65) Prior Publication Data

US 2017/0226810 A1 Aug. 10, 2017

(30) Foreign Application Priority Data

Feb. 9, 2016 (NO) ..... 20160213

(51) Int. Cl.
*E21B 19/14* (2006.01)

(52) U.S. Cl.
CPC ..... *E21B 19/146* (2013.01)

(58) Field of Classification Search
CPC ..... E21B 19/146; E21B 19/20; E21B 19/14; E21B 19/15; E21B 19/155; B65G 1/0442
USPC ..... 414/22.51, 22.52, 22.63, 22.64, 22.65; 175/52, 85
See application file for complete search history.

(56) References Cited

U.S. PATENT DOCUMENTS 4,445,579 A * 5/1984 Bello ..... E21B 19/146 175/52
2011/0005162 A1 1/2011 Roodenburg et al.
2012/0103623 A1 5/2012 Wijning et al.
2012/0305261 A1* 12/2012 Roodenburg ..... E21B 15/02 166/352
2015/0048038 A1 2/2015 Roodenburg et al.
2016/0090796 A1 3/2016 Roodenburg et al.

FOREIGN PATENT DOCUMENTS

CA 1 203 528 A 4/1986
CN 203867494 U 10/2014
NO 156700 B 7/1987

OTHER PUBLICATIONS

"Roto Trip System", Moss Rosenberg Verft a.s. et al, Brochure, p. 1-2 (1983).

* cited by examiner

*Primary Examiner* — David Carroll
(74) *Attorney, Agent, or Firm* — Norman B. Thot

(57) ABSTRACT

A storage system for storing elongate tubulars includes a base with a drive and a setback area for a vertical support of the elongate tubulars, an elongate column mounted on the base, and a first fingerboard assembly arranged on the elongate column. The base rotates about a vertical axis via the drive. The first fingerboard assembly includes at least one fingerboard. Each of the at least one fingerboard includes a plurality of storage slots arranged in a parallel, side-by-side configuration. Each of the plurality of storage slots receives a plurality of the elongate tubulars.

10 Claims, 5 Drawing Sheets

STORAGE ARRANGEMENT FOR WELL OPERATIONS

CROSS REFERENCE TO PRIOR APPLICATIONS

Priority is claimed to Norwegian Patent Application No. NO 20160213, filed Feb. 9, 2016. The entire disclosure of said application is incorporated by reference herein.

FIELD

The present invention relates to storage arrangement for subsea or well operations, and more particularly to an arrangement for storing tools, equipment or other items used in drilling, well intervention, subsea mining, or any similar operation.

BACKGROUND

Various types of storage devices are used in subsea or well operations, such as petroleum drilling, to store tools and equipment so that they are readily available when needed. In such operations, a string is commonly assembled topside by a plurality of segments which are successively connected to the string and lowered down towards a sea floor or down through a wellbore.

Tubular storage devices, such as fingerboards, on mechanized or automated handling systems are typically arranged as x-y oriented storage facilities on a fixed permanent setback base. Some prior art describes systems arranged as barrel- or rotating magazines with a single pick up point and radial storage axis and radially arranged pick up points.

Due to the strict space restrictions, for example, on offshore drilling rigs, a continuous need exists for more efficient storage arrangements, in particular for storage arrangements which provide high storage capacity and which provide a quick and easy access for, for example, a pipe handling machine.

SUMMARY

An aspect of the present invention is to provide an improved storage arrangement which obviates or reduces the disadvantages associated with known solutions.

In an embodiment, the present invention provides storage system for storing elongate tubulars which includes a base comprising a drive and a setback area for a vertical support of the elongate tubulars, the base being configured to rotate about a vertical axis via the drive, an elongate column mounted on the base, and a first fingerboard assembly arranged on the elongate column. The first fingerboard assembly comprises at least one fingerboard. Each of the at least one fingerboard comprises a plurality of storage slots arranged in a parallel, side-by-side configuration. Each of the plurality of storage slots is configured to receive a plurality of the elongate tubulars.

BRIEF DESCRIPTION OF THE DRAWINGS

The present invention is described in greater detail below on the basis of embodiments and of the drawings in which.

DETAILED DESCRIPTION

Figures 1, 1A, 1B, 1C, 1D:
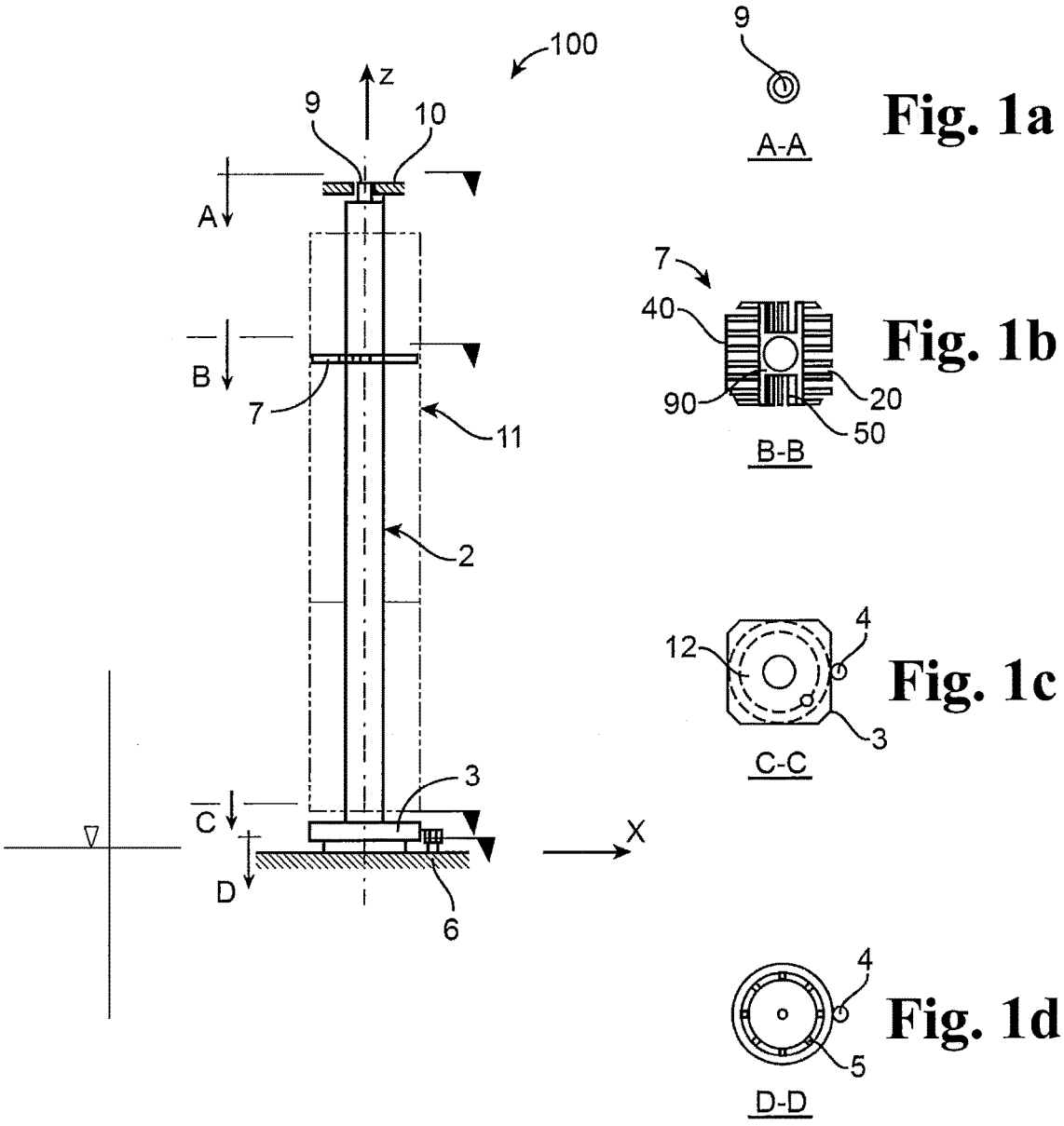
FIG. 1 shows a storage arrangement according to an embodiment of the present invention with FIG. 1 *a-d* showing sectional views.

The present invention relates to storage of drill pipes, casing, bottom hole assemblies, risers, or any elongate tool that is needed on an offshore drilling or well intervention vessel or in any kind of subsea operation using tubular shaped tools. Other examples include research vessels, geothermal drilling, deep sea mining etc.

In an embodiment, the present invention provides a storage system (100) for storing elongate tubulars (1) which includes a base (3) comprising a setback area (12) for a vertical support of the elongate tubulars (1), an elongate column (2) mounted on the base (3), and a first fingerboard assembly (7) arranged on the elongate column (2). The base (3) is configured to rotate about a vertical axis (Z) via a drive (4). The first fingerboard assembly (7) comprises at least one fingerboard (20,30,40,50). Each of the at least one fingerboard (20,30,40,50) comprises a plurality of storage slots arranged in a parallel, side-by-side configuration. Each of the plurality of storage slot is adapted to receive a plurality of the elongate tubulars (1).

In an embodiment of the present invention, the fingerboard assembly can, for example, have a non-circular shape, for example, a substantially octagonal shape or a substantially square shape.

In an embodiment of the present invention, the first fingerboard assembly can, for example, comprise a plurality of fingerboards, for example, two, three or four fingerboards.

In an embodiment of the present invention, the storage slots in at least two of the plurality of fingerboards are of different width so as to accommodate the storage of elongate tubulars having a different diameter.

In an embodiment of the present invention, the storage system can, for example, further comprises a second fingerboard assembly arranged on the elongate column, the second fingerboard assembly having at least one fingerboard.

It can be advantageous, for example, if the first fingerboard assembly and the second fingerboard assembly are adapted to store elongate tubulars having a different diameter.

In an embodiment of the present invention, the first fingerboard assembly can, for example, be arranged on the elongated column so as to be longitudinally spaced apart from the second fingerboard assembly.

It can be advantageous, for example, if the second fingerboard assembly is releasably connected to the elongate column and adapted to be selectively arranged in one of a plurality of longitudinal positions on the elongate column.

In an embodiment, the present invention provides a storage system for storing elongate tubulars. The storage system includes a base comprising a setback area for vertical support of the elongate tubulars and an elongate column mounted on the base. The base is arranged to be rotatable about a vertical axis by a drive. A first fingerboard assembly is arranged on the elongate column. The first fingerboard assembly has at least one fingerboard. A second fingerboard assembly is arranged on the elongate column. The second fingerboard assembly has at least one fingerboard. The first fingerboard assembly is arranged on the elongated column so as to be longitudinally spaced apart from the second fingerboard assembly.

It can be advantageous, for example, if at least one of the first or second fingerboard assemblies is releasably connected to the elongate column and adapted to be selectively arranged in one of a plurality of longitudinal positions on the elongate column.

In an embodiment, the present invention provides a drilling rig arrangement which includes a first and a second storage system as described above, which further includes a first and a second well center and a first and a second pipe handling machine operable on a track. The track extends between the first and second storage systems and the first and second well centers.

It can be advantageous, for example, if the track extends to a parking zone. The parking zone is spaced from a working area of the pipe handling machines.

Tubular storage devices are commonly referred to as fingerboards and setbacks, where the fingerboard is holding tubulars upright within storage slots and the setback below carries the weight of the tubulars.

An embodiment of the present invention will now be described under reference to FIGS. 1 and 2. This particular embodiment is adapted for use with a drilling rig. FIG. 1 shows a storage rack 100 which provides storage facilities for a plurality of tubulars 1 (see FIG. 2). The storage rack 100 comprises a vertically-oriented center column 2 supported by a rotary base 3. The rotary base 3 carries the weight of the structure and the payload. The rotary base 3 comprises a rotary drive 4 and bearings 5 adapted to allow rotation of the center column 2 around a vertical axis Z. The rotary drive 4 may, for example, be an electric motor which can, for example, drive the rotation of the center column 2 and hold the center column in any desired rotational orientation. The rotary drive 4 for rotating the tower can alternatively be provided as skidding cylinders, rack and pinion, hydraulic, electrical, or other forms of mechanical transmission. The rotary base 3 rests on the bearings 5 to enable the rotation of the storage rack between different working positions (described further below). The rotary base 3 may rest on a drill floor 6 of an offshore drilling rig.

A fingerboard assembly 7 is fixed to the center column 2. The fingerboard assembly 7 comprises four fingerboards 20,30,40,50, each fingerboard having a plurality of storage slots 21, 22, 23 (see FIG. 2) for tubulars. An upper column bearing 9 supports the center column 2 against a pipehandling tower structure 10 (see also FIG. 2). The upper end of center column 2 is thus supported in that the bearing 9 takes up horizontal loads from, for example, wind loads, and vessel motion if placed on a floating vessel.

In use, the storage rack 100 forms a support for tubulars, for example, sections of drill string, whereby the rotary base 3 comprises a setback area 12, i.e., vertical support for the lower end of each tubular 1, while the fingerboard assembly 7 locks the upper end of each tubular 1 in the horizontal plane. The fingerboard assembly 7 may be equipped with latches (not shown) to secure each tubular 1 in a manner known in the art.

Figure 2:
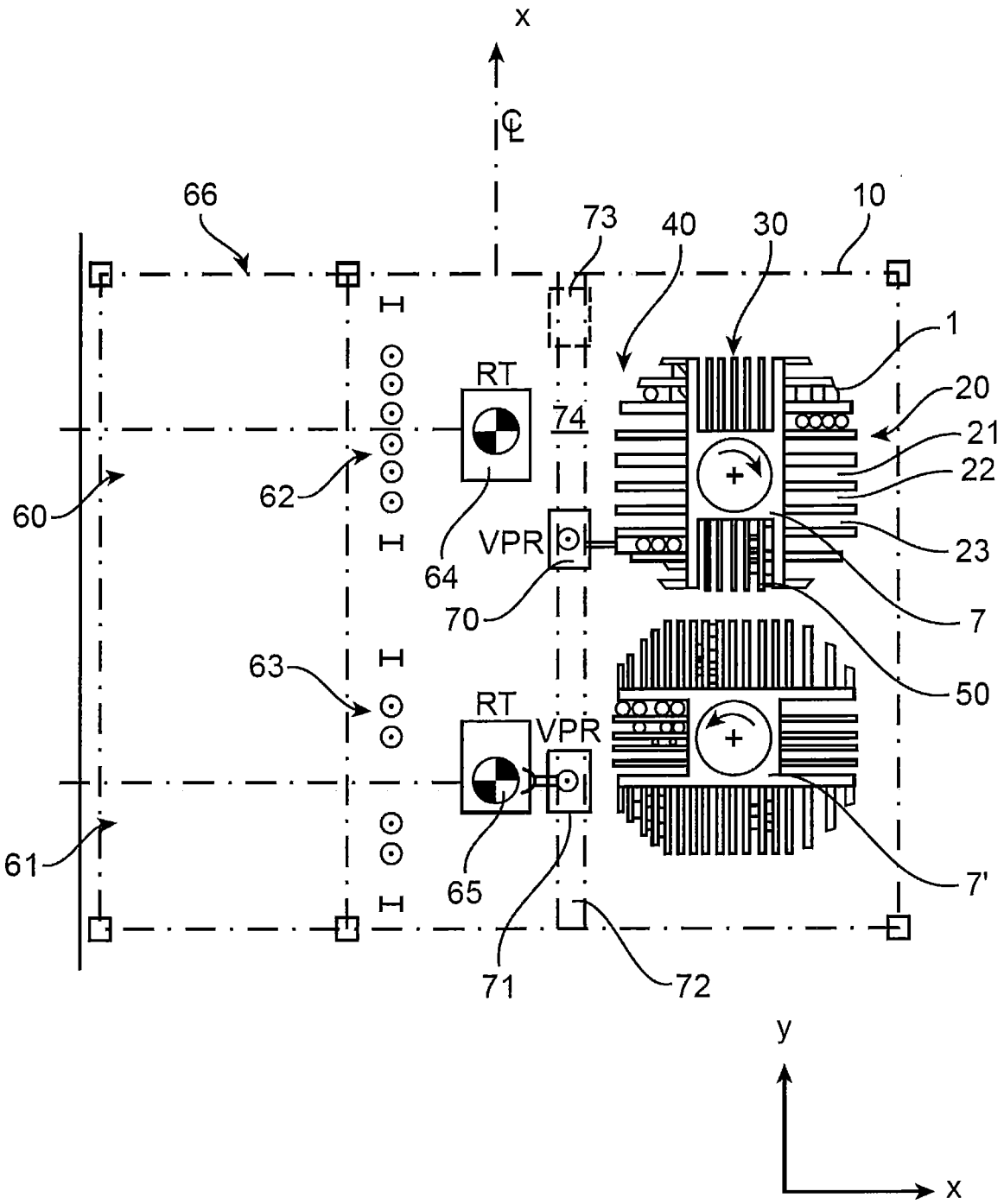
FIG. 2 shows a dual drilling rig setup with two storage arrangements according to the embodiment shown in FIG. 1.

As can also be seen in FIG. 2, the fingerboard assembly 7 comprises a first fingerboard 20 (see FIG. 2), the first fingerboard 20 having plurality of individual slots 21, 22, 23 to receive tubulars 1. Each individual slot 21, 22, 23 is adapted to receive a plurality of tubulars 1 or, alternatively, dedicated special tools. The plurality of slots 21, 22, 23 are arranged in parallel and side-by-side. Further fingerboards 30, 40, 50 are provided in the fingerboard assembly 7. The individual slots in the further fingerboards 30, 40, 50, are equivalently arranged in parallel and side-by-side. Four fingerboards are used in the shown embodiment, however, a fingerboard assembly may equally well have one, two, three, or more than four fingerboards. If the fingerboards assembly 7 comprises more than one fingerboard, these may be arranged with their front openings displaced in different radial directions around the center column 2. A frame/bracket 90 (see FIG. 1) holds the fingerboards 20,30,40,50 in the fingerboard assembly 7. The frame 90 also has attachment points for the fingerboards assembly 7 to the center column 2.

The storage rack 100 has a setback envelope 11 (see FIG. 1) spanning the outer periphery of the storage rack 100. The setback envelope 11 thus determines the available working area for a pipe handling machine in relation to the storage rack 100.

The fingerboard assembly 7 may optionally have a non-circular shape. In an embodiment, the fingerboard assembly 7 has a substantially octagonal shape. In an embodiment, the fingerboard assembly 7 has a substantially square shape. The rotary base 3 may optionally be designed with substantially the same shape as the fingerboard assembly 7. The rotary base 3 may alternatively have a substantially square shape independent of the shape of the fingerboard assembly 7. The rotary base 3 may alternatively have a substantially circular shape independent of the shape of the fingerboard assembly 7. The rotary base 3 may have a larger area than the fingerboard assembly 7.

Providing a fingerboard assembly 7 and/or rotary base 3 with such a design increases the storage capacity of the storage rack 100.

FIG. 2 shows a drill floor arrangement having a main rig 60 and an auxiliary rig 61. The main rig 60 and the auxiliary rig 61 comprise hoisting systems 62 and 63, respectively, which operate in relation to a first well center 64 and a second well center 65. In the shown embodiment, the hoisting systems 62 and 63 are RamRig™ hoisting systems which have been offered in the market by the current applicant for a number of years, however, these may also be of any other design. A ram guide superstructure 66 supports the hoisting systems and other, associated components. This drill floor configuration is well known to those skilled in the art and is therefore not here further described.

The drill floor arrangement shown in FIG. 2 further comprises two storage racks according to that shown in FIG. 1, having fingerboard assemblies 7 and 7', respectively. Two pipe handling machines 70 and 71 operate on tracks 72 arranged between the first well center 64 and the second well center 65 and the two storage racks 100. In the shown embodiment, the two pipe handling machines are vertical pipe rackers (VPR) adapted to position a tubular pipe section or other tool vertically above one of the well centers so that the hoisting system can engage the pipe section or tool to carry out some operation. The tracks 72 are arranged so that each pipe handling machine can operate on both storage racks. The tracks 72 further extend to allow parking of the VPR in a parking zone 73 out of the working area 74 between a storage rack and a well center 64. This gives redundancy in the pipe handling system in that one pipe handling machine can operate on both storage racks 200 and/or both well centers.

The two storage racks are supported by a pipehandling tower structure 10. The storage racks 100 are positioned so that each VPR can engage tubulars 1 or other tools stored in any of the fingerboards 20,30,40,50 when the relevant fingerboard is directed towards the VPR. The VPR may then pick up such an item from the storage racks 100 and position it above the well center, or remove an item suspended by the hoisting system above the well center and bring it for storage in a slot in the storage racks 100. In FIG. 2, the first pipe handling machine 70 can be seen picking up a pipe section from the fingerboard 40, while the second pipe handling machine 71 is engaging an item above the second well center 65.

In an embodiment, the fingerboards 20,30,40,50 can, for example, be configured to facilitate holding of different tubular types, lengths, longitudinal configuration and diameters. This can be achieved by designing the width and design of the storage slots in individual fingerboards to accommodate different items. Various combinations are possible in which the storage rack may contain tubular storage devices on one or more sides, or be arranged for storage of other material element or tools to be utilized. For example, in FIG. 2, the fingerboard 40 can be designed to store drill pipe, while the fingerboard 20 can be designed to store sections of casing. The fingerboards 30 and 50 can additionally, or alternatively, be designed to store other types of tubular, or tools and equipment used in the drilling operation. Examples of this can be well intervention equipment, completion tools or even separate specialized handling systems for dedicated task such as special roughneck, casing tong or other. Rotating the storage rack via the drive 4 allows quick access to alternative fingerboards.

Figure 3:
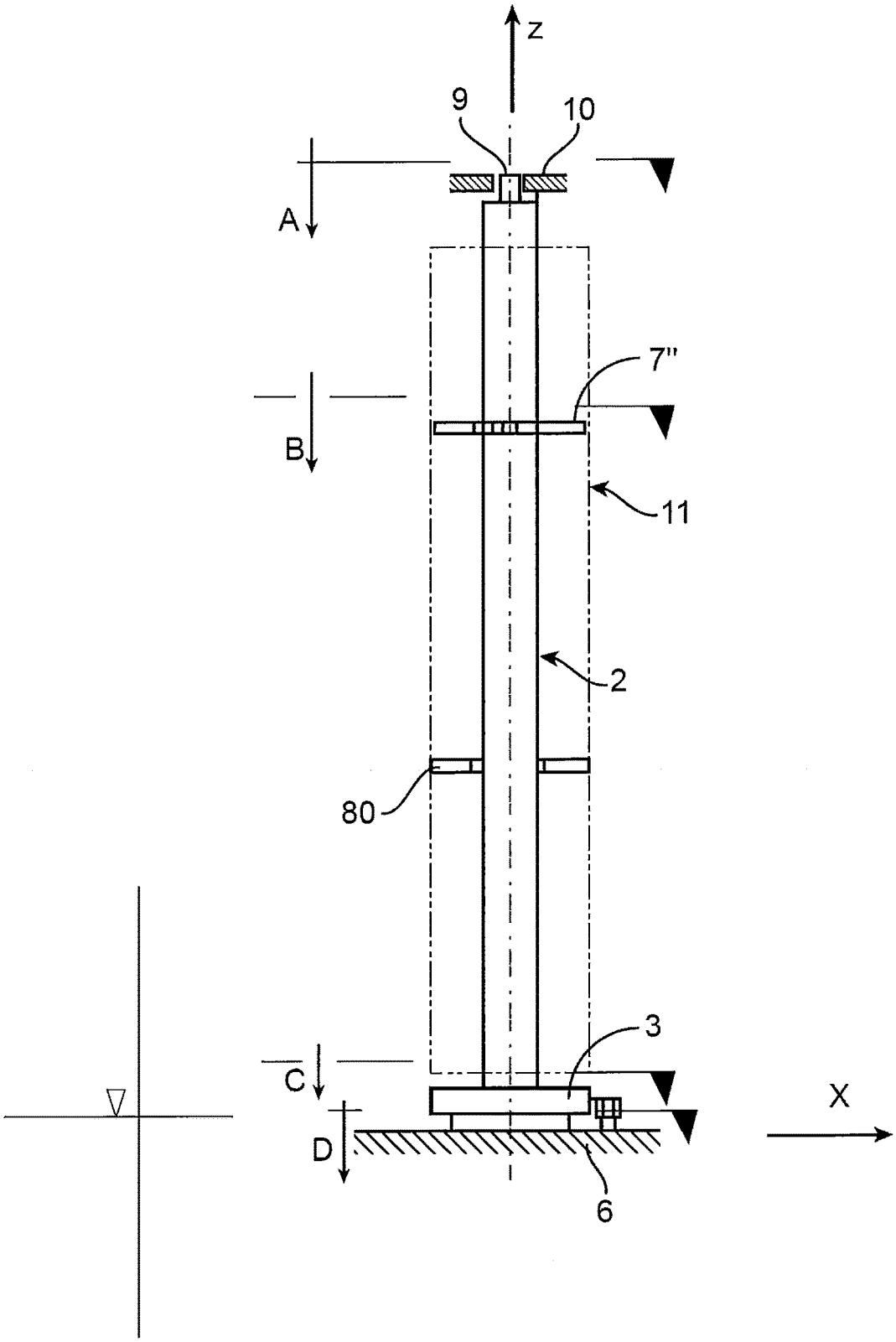
FIG. 3 shows a storage arrangement according to an embodiment of the present invention.

FIG. 3 shows an embodiment according to one aspect of the present invention. Similarly to the embodiment shown in FIG. 1, a rotary base 3 with a center column 2 is provided and positioned on a drill floor 6. The center column is supported by a tower structure 10 via an upper column bearing 9.

A fingerboard assembly 7" is arranged on the center column 2. The fingerboard assembly 7" may have a design substantially equivalent to the fingerboard assembly 7 described above. The fingerboard assembly 7" may alternatively comprise one, two, three, or more than four fingerboards.

A second fingerboard assembly 80 is further arranged on the center column. The second fingerboard assembly 80 may comprise one or more fingerboards. In the embodiment shown in FIG. 3, the second fingerboard assembly 80 comprises one fingerboard, the second fingerboard assembly 80 having a design equivalent to the fingerboard assembly 7 described above but with only fingerboard 20 (i.e., fingerboards 30,40,50 removed). Fingerboard assembly 80 thus provides support for tubulars only on one side of the center column 2.

As can be seen in FIG. 3, the second fingerboard assembly 80 is arranged at the center column 2 at a lower elevation than fingerboard assembly 7". The second fingerboard assembly 80 may thus provide support and storage of shorter tubulars (or other tools). In the arrangement shown in FIG. 3, it is therefore possible to store tubulars of different lengths at different sides of the storage rack, with all tubulars being supported at their lower end by the setback in the base 3, and at their upper end by the fingerboard in either the fingerboard assembly 7" or the second fingerboard assembly 80. This provides the possibility to change heights and configurations on the working side simply by rotating the storage rack.

The second fingerboard assembly 80 can optionally be arranged to be releasably connected to the center column 2 and arranged to be selectively attached to the center column 2 at different heights. This can be achieved by providing a releasable mechanical connection between the frame of the second fingerboard assembly 80 and the center column 2 and, along the center column 2, a plurality of interfacing points (or brackets, see FIGS. 4 and 5) for the mechanical connection. If relocation is desired, the second fingerboard assembly 80 can be released and hoisted or lowered to a new position, and re-attached.

Several fingerboard assemblies can optionally be arranged in various vertical levels. This permits the storage rack to be adapted to the needs of any particular operation, e.g., drilling, well intervention, etc.

Figure 4:
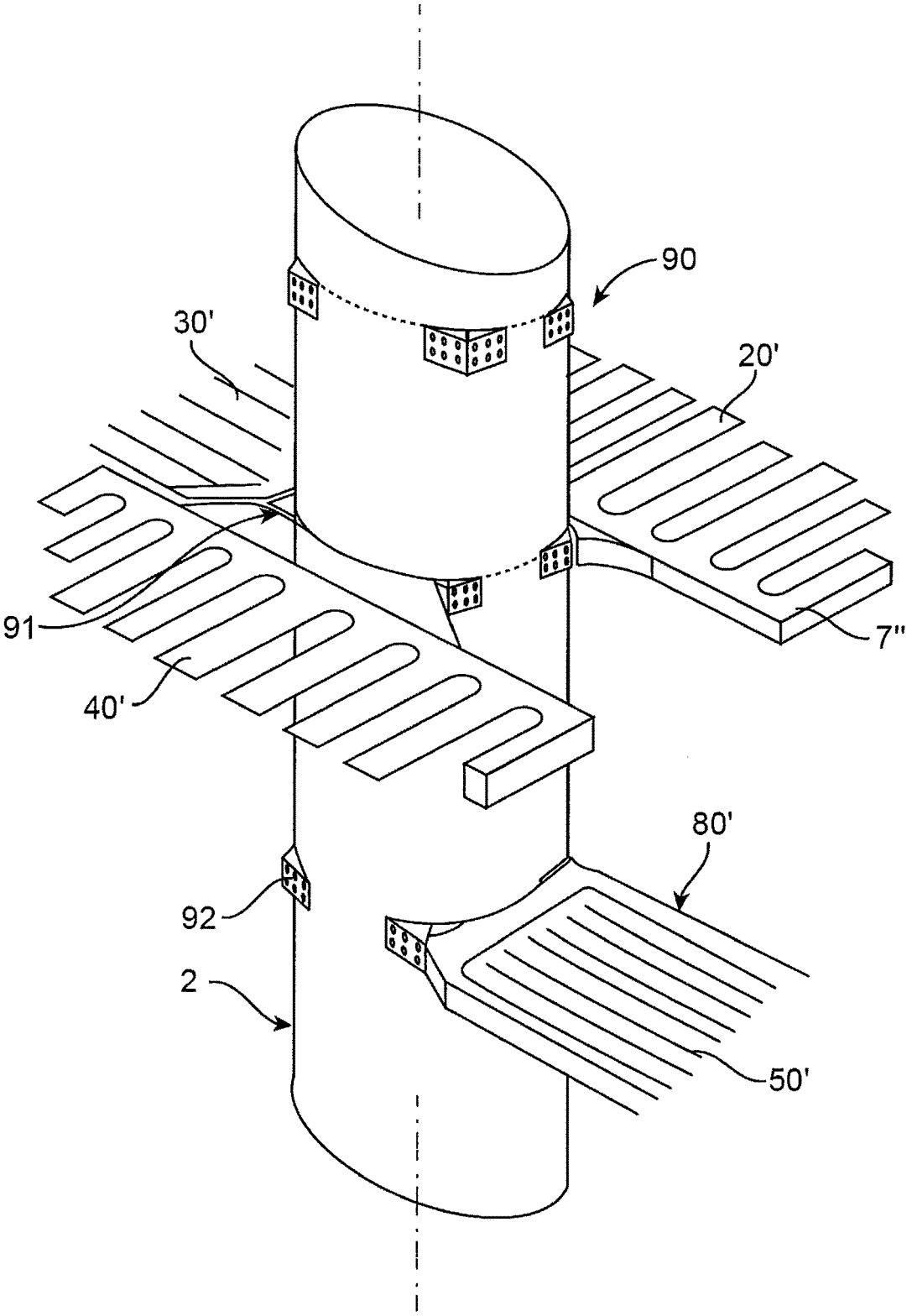
FIG. 4 shows a partial view according to an embodiment of the present invention.

In an embodiment of the present invention, FIG. 4 shows a storage rack comprising a center column 2 adapted to be mounted on a rotary base 3, as described above. In FIG. 4, brackets 90, 91 and 92 are provided in sets at different heights of the center column 2, allowing the attachment of fingerboards assemblies at different heights. In FIG. 4, a first fingerboard assembly 7" is provided and fixed to the brackets 91. The first fingerboard assembly comprises fingerboards 20', 30', and 40'. A second fingerboard assembly 80' is provided and fixed to the brackets 92. The second fingerboard assembly comprises fingerboard 50'. The fingerboards 20', 30', 40', and 50' are provided with storage slots in an x-y configuration.

Figure 5:
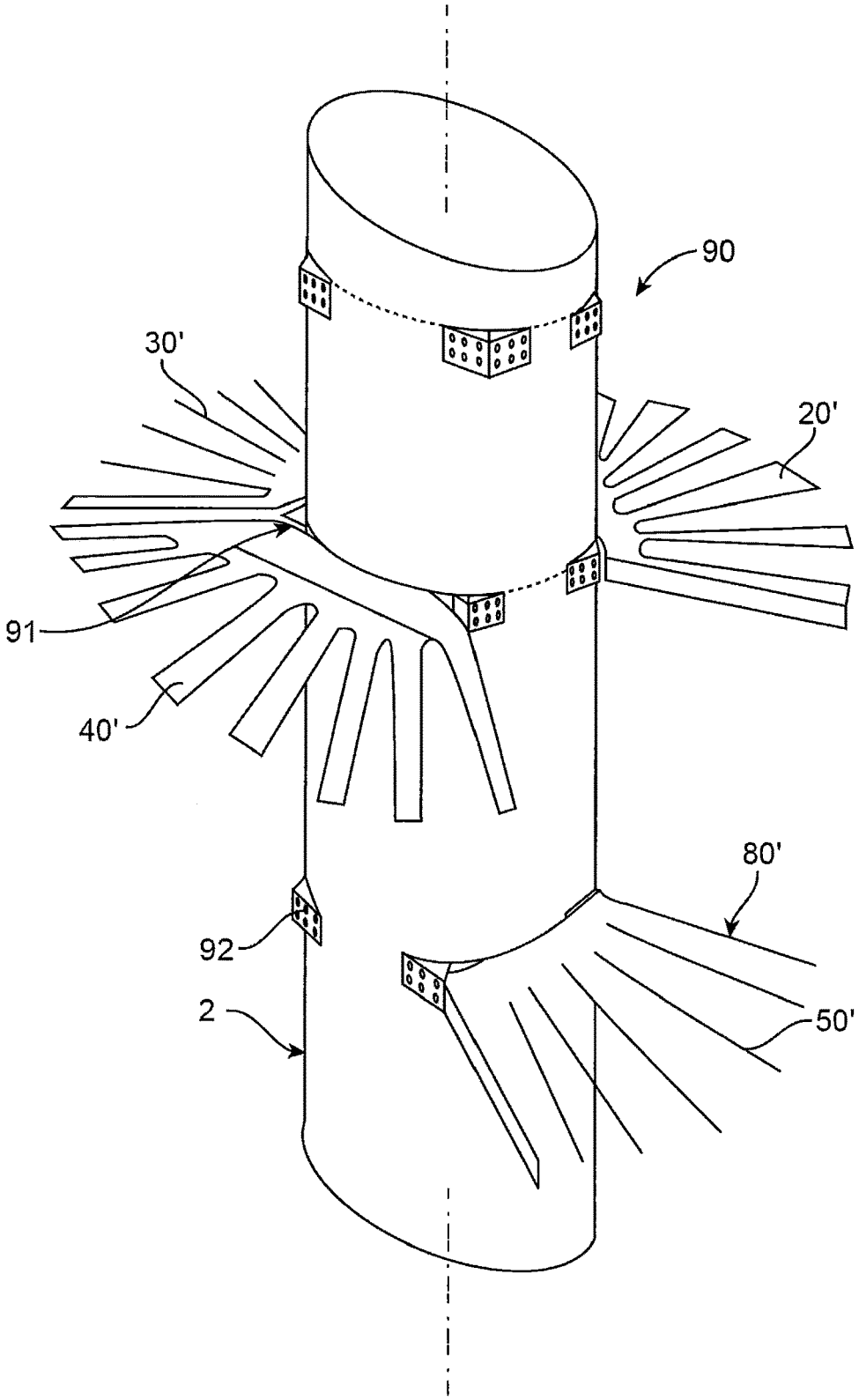
FIG. 5 shows a partial view according to an embodiment of the present invention.

FIG. 5 shows an embodiment similar to that in FIG. 4, but in which the fingerboards 20', 30', 40', and 50' are provided with radial storage slots.

When increasing lengths of tubulars are to be stored, for example, during deepwater drilling operations, embodiments of the present invention thus enables the use of conventional xy handling systems without requiring an increased width or length of the total storage area. The combination of a rotatable storage rack with storage slots arranged in xy-pattern enable a batch shift of the working position, where a large portion of tubular or stored items can be reached from the handling system in each working position (i.e., fingerboards 20, 30, 40 or 50 facing the VPR and well center). The system does not require a continuous change of working position of the storage rack when picking up a new tubular from storage, and allows the use of a traditional two arm vertical pipehandling system (VPH) or a column based vertical piperacker (VPR). Storage arrangements according to the present invention therefore improve utilization of deck layout.

The present invention is not limited to embodiments described herein; reference should be had to the appended claims.

What is claimed is:

1. A storage system for storing elongate tubulars, the storage system comprising:

a base comprising a drive and a setback area for a vertical support of the elongate tubulars, the base being configured to rotate about a vertical axis via the drive;

an elongate column mounted on the base; and a first fingerboard assembly arranged on the elongate column, the first fingerboard assembly comprising at least two fingerboards, each of the at least two fingerboards comprising a plurality of storage slots arranged in a parallel, side-by-side configuration, each of the plurality of storage slots being configured to receive a plurality of the elongate tubulars, wherein, the plurality of storage slots in the at least two fingerboards comprise a different width so as to store elongate tubulars having a different diameter.

2. The storage system as recited in claim 1, wherein the first fingerboard assembly comprises a non-circular shape.

3. The storage system as recited in claim 2, wherein the non-circular shape is an octagonal shape.

4. The storage system as recited in claim 2, wherein the non-circular shape is a square shape.

5. The storage system as recited in claim 1, wherein the at least two fingerboards comprise two fingerboards, three fingerboards, or four fingerboards.

6. The storage system as recited in claim 1, further comprising:

a second fingerboard assembly arranged on the elongate column, the second fingerboard assembly comprising at least one fingerboard.

7. The storage system as recited in claim 6, wherein the first fingerboard assembly and the second fingerboard assembly are each configured to store elongate tubulars having a different diameter.

8. The storage system as recited in claim 7, wherein the first fingerboard assembly is arranged on the elongate column so as to be spaced apart from the second fingerboard assembly when viewed perpendicular to a longitudinal direction of the elongate column.

9. The storage system as recited in claim 8, wherein the second fingerboard assembly is configured to be releasably connected to the elongate column and to be selectively arranged in one of a plurality of longitudinal positions on the elongate column.

10. A storage system for storing elongate tubulars, the storage system comprising:

a base comprising a drive and a setback area for a vertical support of the elongate tubulars, the base being configured to rotate about a vertical axis via the drive;

an elongate column mounted on the base;

a first fingerboard assembly arranged on the elongate column, the first fingerboard assembly comprising at least one fingerboard; and a second fingerboard assembly arranged on the elongate column, the second fingerboard assembly comprising at least one fingerboard, wherein, the first fingerboard assembly is arranged on the elongate column so as to be spaced apart from the second fingerboard assembly when viewed perpendicular to a longitudinal direction of the elongate column, and at least one of the first fingerboard assembly and the second fingerboard assembly is configured to be releasably connected to the elongate column and to be selectively arranged in one of a plurality of longitudinal positions on the elongate column.

* * * * *